US005219321A

United States Patent [19]

Schwebbach

[11] Patent Number: 5,219,321

[45] Date of Patent: Jun. 15, 1993

[54] ZIGZAG FOLDING APPARATUS

[75] Inventor: Paul Schwebbach, Darmstadt, Fed. Rep. of Germany

[73] Assignee: Maschinenfabrik Goebel GmbH, Darmstadt, Fed. Rep. of Germany

[21] Appl. No.: 836,728

[22] Filed: Feb. 19, 1992

[30] Foreign Application Priority Data

Jul. 23, 1990 [DE] Fed. Rep. of Germany ..... 4023344

[51] Int. Cl.[5] ..... B65H 45/20

[52] U.S. Cl. ..... 493/414; 493/476

[58] Field of Search ..... 270/39, 40; 493/411–415, 476

[56] References Cited

U.S. PATENT DOCUMENTS 3,889,940 6/1975 Jakob ..... 493/415

4,401,428 8/1983 Thomas ..... 493/411

4,828,540 5/1989 Fordyce ..... 493/414

FOREIGN PATENT DOCUMENTS 894791 4/1962 Fed. Rep. of Germany ..... 493/415

*Primary Examiner*—Bruce M. Kisliuk

*Assistant Examiner*—Jack Lavinder

*Attorney, Agent, or Firm*—Watson, Cole, Grindle & Watson

[57] ABSTRACT

A folding apparatus for delivering a web of paper or the like in zigzag folds has a cam assembly mounted on only one side of the edge of the web for oscillating the web guide channel devices which includes a rotary shaft located between the cam assembly and the guide channel devices. The cam assembly is adjustable for changing the web format.

5 Claims, 2 Drawing Sheets

ZIGZAG FOLDING APPARATUS

This is a continuation of International application PCT/DE91/00573, filed on Jul. 12, 1991, which designated the United States and is now abandoned.

BACKGROUND OF THE INVENTION

This invention relates generally to an apparatus which may have a pair of reciprocating guide channel devices for delivering a web of paper, foil, fabric, plastic, metal or the like downwardly from a web conveyor in zigzag folds. More particularly, the apparatus includes rotating cams for reciprocating the guide channel devices, and an oscillatory shaft through which the devices are coupled with the cams for reciprocating the guide channel devices upon cam rotation. The cams are mounted on only one side of the machine frame, and are adjustable for changing the oscillation amplitude of the devices.

An adjustable folding apparatus relating to the invention is disclosed in U.S. Pat. No. 3,889,940, commonly owned herewith. That apparatus includes pairs of cams rotatably mounted on the machine frame respectively at opposite sides of the web, the cam pairs supporting drive rods for reciprocating guide channel devices which effect zigzag web folding. The cam pairs must be driven in synchronization via a common shaft and cooperating gear arrangements. To adjust the cams for changing the oscillation amplitude of the guide channel devices, it is necessary to shift both cam pairs to the same degree, such that the cam adjustments at opposite sides of the web must be synchronized.

Such adjustments are necessary, for example, to obtain different sizes, i.e., different formats of the stacks that are zigzag folded.

SUMMARY OF THE INVENTION

It is therefore an object of the present invention to improve upon the prior art as aforedescribed by providing a folding apparatus of simpler design yet highly effective in adjusting the cams for changing the oscillation amplitude of the guide channel devices.

To this end, the cam or cams for the guide channel device or devices are rotatably mounted on the machine frame on only one side edge of the web, such that only a single cam unit need be adjusted for changing the oscillation amplitude of the guide channel devices having sidewalls at opposite edges of the web.

A shaft assembly is journalled on the machine frame for oscillatory movement about a longitudinal axis thereof which lies parallel to the axis about which the cam unit rotates. And, the shaft assembly lies between the cam unit and the guide channel device or devices.

A first drive is operatively coupled to the cam unit and to the shaft assembly for oscillating the shaft assembly about its longitudinal axis. And, a second drive is operatively coupled to the reciprocating guide channel devices and to the shaft assembly for transmitting the oscillatory movement of the shaft assembly to the guide channel devices.

The shaft assembly may include a pair of overlying concentric shafts oscillatory about its longitudinal axis, and a pair of the guide channel devices may be respectively associated with the pair of shafts.

The number of concentric shafts of the shaft assembly can correspond to the number of reciprocating guide channel devices.

Other objects, advantages and novel features of the invention will become more apparent from the following detailed description of the invention shown in the accompanying drawings in which non-essential parts otherwise known are not illustrated for the sake of clarity, but rather show only those parts that are necessary for the detailed description of the invention.

DETAILED DESCRIPTION OF THE INVENTION

Figure 1:
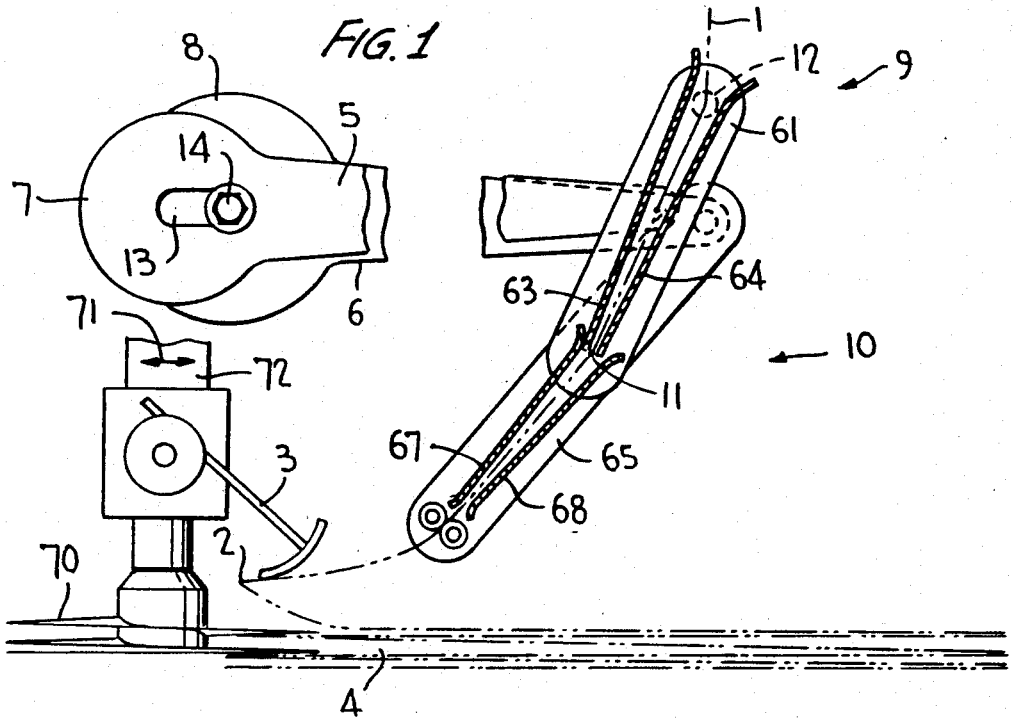
FIG. 1 is a side elevational view of the folding apparatus according to the invention, taken substantially along the line 1—1 of FIG. 2.
Figure 2:
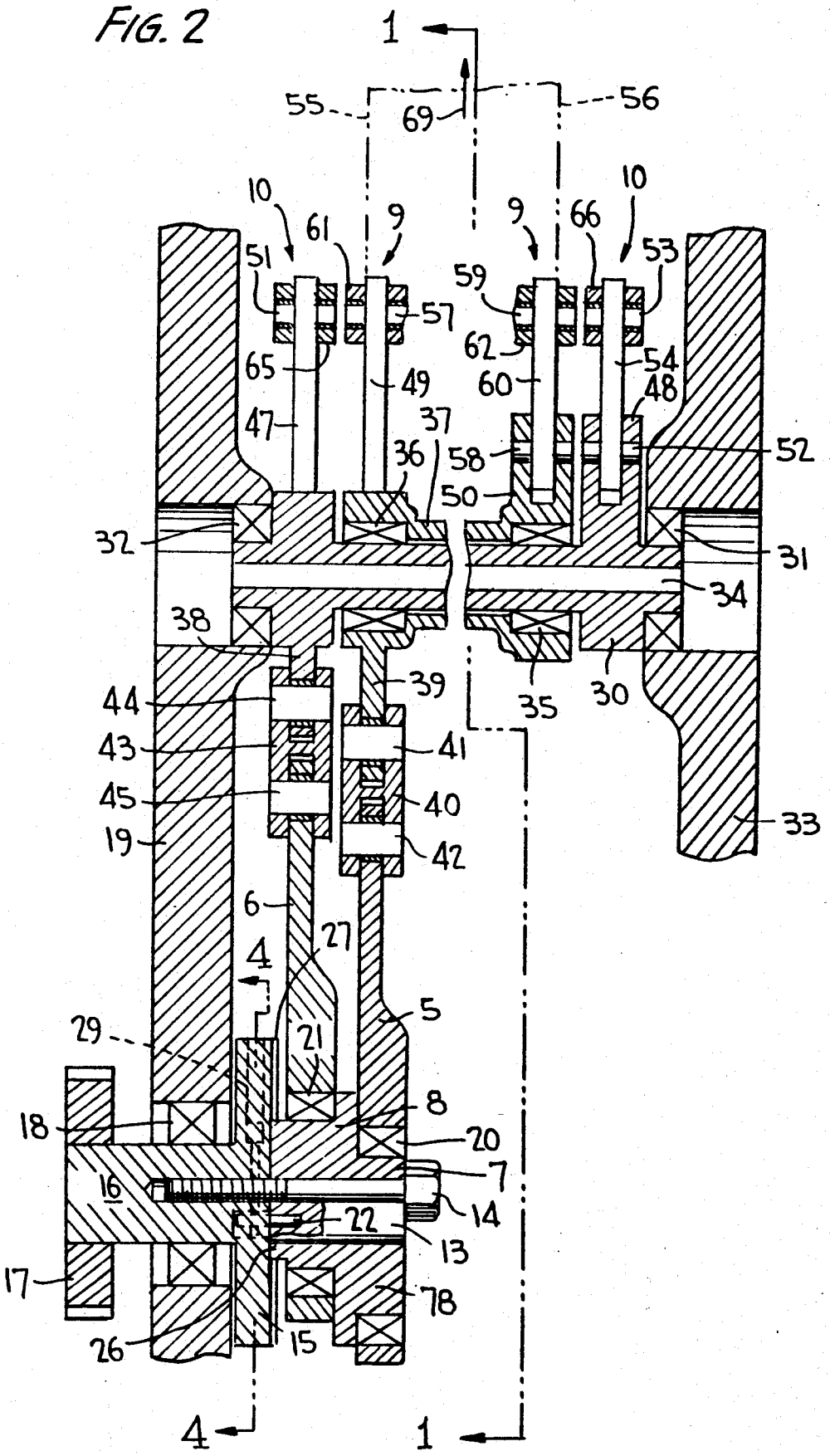
FIG. 2 is a sectional view of the folding apparatus according to the invention taken substantially along the line 2—2 of FIG. 3.

Turning now to the drawings wherein like reference characters refer to like and corresponding parts throughout the several views, a web 1 of paper, foil, fabric, plastic, metal or the like, having spaced lines of perforations extending transversely to its direction of travel, and comprising one or more layers, is moved downwardly from a web conveying device (not shown) into the folding apparatus of FIG. 1 for folding in a manner similar to that described in U.S. Pat. No. 3,889,940. Web is generally shown in phantom outline and is bent in the area of its transverse perforations, e.g., at points 2, by means of a beater 3, to thereby form a zigzag stack 4. For this purpose, web 1 passes through one or more pocket-like hoppers or guide channel devices 9,10 arranged in succession in the formation. direction of the web and forming portions of the web guide channel. The motion of these hoppers is produced by drive rods 5,6, in turn moved by cams 7 and 8 which can be combined into a single cam unit 78 (FIG. 2).

Guide channel devices 9 and 10 are hingedly connected as at 11 so that the devices can be swiveled relative to one another. The upper guide channel device 9 located in the formation direction of the web may be pivotally connected to the machine frame as at 12. Pivot 12 is stationary, whereas hinge 11 is rocked through the movement of drive rod 5. Consequently, the guide channel devices are arranged in succession in the formation direction of the web.

However, a single guide channel can instead be provided, and more than two guide channels can be provided in succession, without departing from the invention.

Cams 7 and 8 may be formed on a single unit 78 (FIG. 2) having an oblong throughbore 13 through which a threaded bolt 14 extends. Element 78 may therefore be securely connected to a flange 15 during operation of the apparatus. Flange 15 is integral with a shaft 16 having a gear wheel 17 thereon. Shaft 16 is mounted on side wall 19 of the machine frame for rotation about its central axis and is journalled in bearings 18. Gear wheel 17 is driven from a suitable source (not shown) for thereby rotating shaft 16 and element 78 and the cams thereof about the central axis of shaft 16.

Drive rod 5 is journalled to cam 7 via a bearing 20, and drive rod 6 is journalled to cam 8 via a bearing 21.

Thus, rotation of element 78 about the central axis of shaft 16 reciprocates rods 5 and 6 for oscillating the guide channels, as will be described in more detail hereinafter.

To adjust for different folded web formats, bolt 14 is loosened to permit element 78 to be shifted in the oblong direction of bore 13, whereafter bolt 14 is tightened in the adjusted position. In such manner the range of motion of drive rods 5 and 6, and thus the stops for the guide channels for the web, can be set. Bolt 14 can be of the standard variety or may be in the form of a tension bolt. Otherwise, differential screws (i.e., having threads of different pitch) or the like can be provided or other suitable force and form locking devices such as gears so as to assure that the desired position of element 78 relative to shaft 16 is maintained upon rotation of element 78, i.e., during the oscillatory motion of the guide channels which may cause element 78 to shift, even while bolt 14 is tightened in place.

Figure 4:
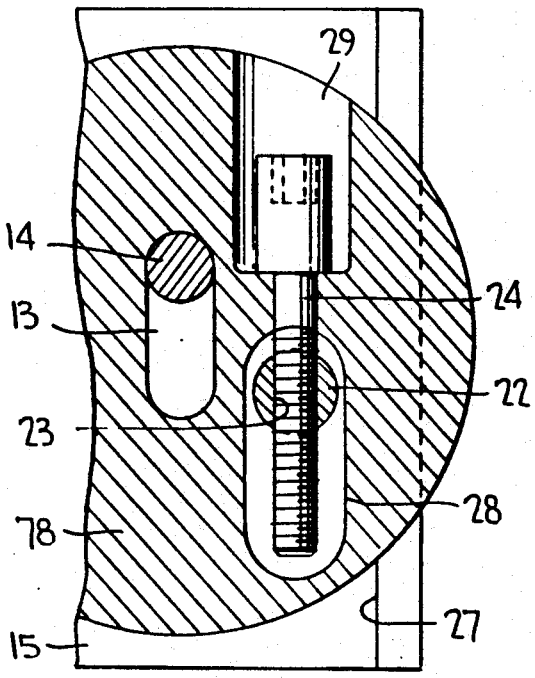
FIG. 4 is a sectional view taken substantially along the line 4—4 of FIG. 2, at an enlarged scale.

Element 78 can be simply and accurately adjusted on flange 15 by the provision of a pin 22 anchored in element 78 and extending into an oblong bore 28 located in flange 15. Pin 22 has an internally threaded bore 23 with which a threaded bolt 24 engages. Bolt 24 extends through bore 25 provided in flange 15 is accessible through recess 29, and engages pin 22, as shown in FIG. 4.

Element 78 has a nose portion 26 extending into a guide groove 27 provided in the face of flange 15, the guide groove Thus, element 78 can be simply and accurately adjusted on flange 15 by loosening bolt 14, and threading or unthreading bolt 24, which thereby shifts pin 22 and the connected element 78 in the direction of guide groove 27. After the adjustment is effected, bolt 14 is simply retightened.

Figure 3:
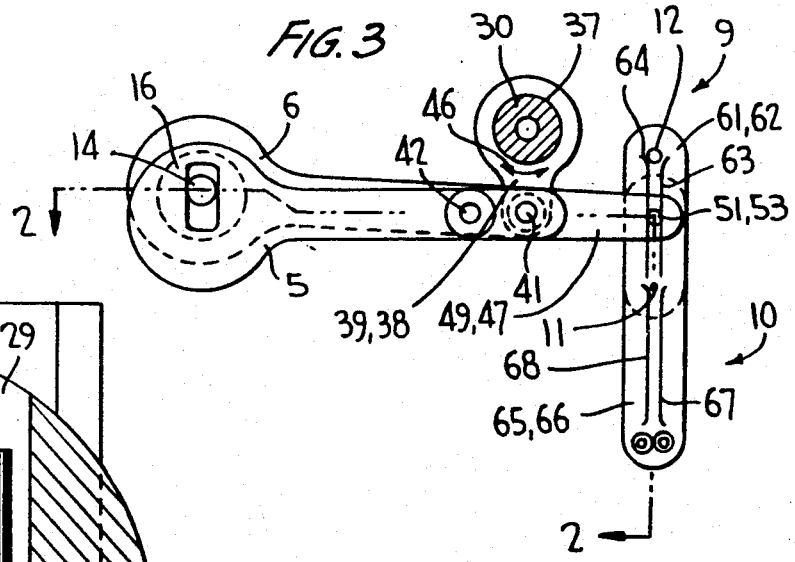
FIG. 3 is a view similar to FIG. 1, at a slightly reduced scale, showing a different phase position of the guide channel devices.

Since the force flow for oscillating the guide channel devices extends from gear wheel 17 through shaft 16, element 78, drive rods 5 and 6 to guide channels 9 and 10, a shaft 30 is arranged in the sense of this force flow, i.e., parallel to the central axis of shaft 16, between element 78 and guide channel devices 9 and 10, as shown in FIG. 3. Shaft 30 is journalled in side walls 19 and 33 of the machine frame via bearings 31 and 32. Shaft 30 can be made hollow so as to contain an axial inner bore 34.

Another hollow shaft 37 is telescoped over shaft 30 and is rotatably journalled thereon via bearings 35 and 36. A first lever arm 38 is integral with or otherwise connected to shaft 30 at the end of the shaft as shown on the left side in FIG. 2. A second lever arm 39 is integral with or otherwise connected to hollow shaft 37. When viewed in FIG. 3, arm 39 overlies arm 38. And, lever arm 39 is pivotally connected to drive rod 5 via a tension rod 40 and pivot pins 41 and 42. Similarly, first lever arm 38 is connected to drive rod 6 via a tension rod 43 and pivot pins 44 and 45. Thus, upon rotation of element 78, drive rods 5 and 6 are put into reciprocating rotary movement, which movement effects reciprocation of shafts 30 and 37 in the direction of double arrow 46 shown in FIG. 3. In FIG. 3, pivot pins 44 and 45 lie in the line of vision behind hinges 41 and 42.

Also, shaft 30 is provided with a third lever arm 47 and a fourth lever arm 48, while hollow shaft 37 is provided with a fifth lever arm 49 and a sixth lever arm 50. Lever arm 47 is connected to the lower guide channel 10 via a pivot pin 51. Similarly, lever arm 48 is connected to the lower guide channel via pivot pins 52 and 53 and an intervening tension rod 54. Thus, pins 51 and 53 are located in the vicinity and outwardly of the respective side edges 55 and 56 of web 1, and are coaxial relative to one another.

Similarly, lever arm 49 is connected to upper guide channel 9 via a pivot pin 57, and lever arm 50 is connected to guide channel 9 via pivot pins 58 and 59 and an intervening tension rod 60.

Guide channel device 9 essentially comprises side plates 61 and 62, and guide plates 63,64. Similarly, guide channel device 10 comprises side plates 65 and 66, and guide plates 67,68.

Since shaft 30 and hollow shaft 37 oscillate in the direction of double arrow 46, the upper and lower guide channel devices 9 and 10 for web 1 to be folded into a zigzag stack also oscillate due to the aforedescribed interconnections. And, since element 78 of the combined cam assembly can be displaced in the direction of oblong bore 13, guide channel devices 9 and 10 can be set into different oscillatory movements by varying degrees so that the different reciprocal distances of points 2 can be taken into account to change the zigzag web formats.

Since only one cam assembly, i.e., element 78, needs to be adjusted such as with the aid of adjusting bolt 24, only such cam assembly rotatably mounted on only one side edge 55 of web 1 needs to be adjusted in order to obtain the desired adjusted formats, despite there being guide channel driving devices being adjacent both sides of the channel devices, i.e., located parallel to both side edges 55 and 56 of the web. This results in a simple format change and employs a simple operation of the apparatus, together with a simple construction of the entire folding device which nevertheless avoids undesirable rocking movements of the guide channel devices driven only on one side. This simple yet highly effective arrangement of the present folding apparatus is especially noteworthy when considering that a bilateral drive of the guide channel devices is necessary from the start due to today's high speeds.

The guide channel shown in FIG. 1 comprises two guide channel devices 9 and 10, and correspondingly two telescoping and concentric shafts 30 and 37 to enable that each part of the guide channel receives the drive associated with it. If the oscillating portion of the guide channel comprises only a single guide channel device, then only a single shaft 30 is necessary. Otherwise, if the oscillating portion of the guide channel comprises two or more guide channel devices, then correspondingly several concentric hollow shafts are telescoped about shaft 30 to enable each of these oscillating channels to receive the related drives.

Drive rods 5 and 6 as well as pivots 41, 42, 44 and 45, and tension rods 40 and 43, essentially comprise a first drive means which are interconnected, at least in the sense of the force flow driving the guide channel device, between cam assembly 78 and oscillating shaft 30. Lever arms 47, 48, 49 and 50 as well as the related pivot pins 51, 52, 53, 57, 58 and 59 and tension rods 54 and 60, essentially comprise a second drive means coupled between shaft 30 or the other concentric shafts and guide channel devices 9 and 10.

For the sake of clarity in FIG. 2, lever arms 47–50 including their related pivots are shown folded upward. In reality, however, the levers are arranged in such manner as shown in FIG. 3.

As readily apparent from FIG. 2, shaft 30 is located essentially vertically to the formation direction of the web, as indicated by arrow 69.

Since cam assembly 78 is located on only one side of the web, i.e., in the vicinity of edge 55 of the web, the cams and associated connecting levers and pivots, i.e., the first drive means, are likewise arranged only at one edge 55 of the web, although a gear-like connection is possible at the opposing edge 56 of the web but at a higher cost and less efficient, although such is not necessary.

To improve depositing the web in zigzag folds, the breaks or points 2 of the web can be grasped and pushed down by the known method with the use of a revolving screw 70 with large size threads. These screws are customarily driven and adjustable in the machine frame in such a manner that they can be adjusted in the direction of double arrow 71 (FIG. 1) so as to be set to different formats to be produced. At least one mounting 72 is normally provided in the machine in such manner that it can be slid and fixed in position, as required, along at least one guide which extends in the direction of arrow 71.

Obviously, many other modifications and variations of the present invention are made possible in the light of the above teachings. It is therefore to be understood that within the scope of the appended claims the invention may be practiced otherwise than as specifically described.

What is claimed is:

1. A folding apparatus for a printing machine, comprising reciprocating guide channel devices for delivering a web of paper or the like downwardly from a web conveyor in zigzag folds, said devices being mounted on a frame of the machine and each having opposing sidewalls located on opposite sides of the web, cam means mounted on said frame for rotation about a predetermined axis and being located at only one side edge of the web for reciprocating said devices via shaft means journalled at opposite ends thereof on said frame, said cam means being adjustable for changing the oscillation amplitude of said devices, said shaft means lying parallel to said predetermined axis between said cam means and said guide channel devices, first drive means being operatively coupled only between said cam means and said shaft means for oscillating said shaft means about a longitudinal axis thereof upon rotation of said cam means, and second drive means being operatively coupled to said opposing sidewalls of each of said guide channel devices and to said shaft means for solely transmitting the oscillatory movement of said shaft means to each of said devices.

2. The apparatus according to claim 1, wherein said shaft means includes a hollow shaft.

3. The apparatus according to claim 1, wherein said shaft means comprise at least a pair of overlying concentric shafts oscillating about said longitudinal axis, and a pair of said guide channel devices being respectively associated with said pair of shafts.

4. The apparatus according to claim 1, wherein a cam shaft is mounted on said frame about the predetermined axis thereof, said cam means being mounted to side cam shaft for shifting movement in a direction perpendicular to said predetermined axis for changing the oscillation amplitude of said cam means and thereby of said guide channel devices.

5. The apparatus according to claim 3, wherein said first and second drive means are coupled to said pair of concentric shafts.

* * * * *